US006503875B1

(12) United States Patent
Olson et al.

(10) Patent No.: US 6,503,875 B1
(45) Date of Patent: Jan. 7, 2003

(54) STABILIZED OXALIC ACID SOUR

(75) Inventors: Lynne Ann Olson, Ellsworth, WI (US); Minyu Li, Oakdale, MN (US)

(73) Assignee: Ecolab Inc., St. Paul, MN (US)

( * ) Notice: Subject to any disclaimer, the term of this patent is extended or adjusted under 35 U.S.C. 154(b) by 0 days.

(21) Appl. No.: 09/642,032

(22) Filed: Aug. 18, 2000

(51) Int. Cl.[7] ..... C11D 1/60
(52) U.S. Cl. ..... 510/346; 510/467
(58) Field of Search ..... 510/346, 431, 510/467

(56) References Cited

U.S. PATENT DOCUMENTS

| | | | | | |
|---|---|---|---|---|---|
| 4,153,744 | A | * | 5/1979 | Remley | 427/160 |
| 4,156,747 | A | * | 5/1979 | Wagner | 427/341 |
| 4,265,945 | A | | 5/1981 | Frank | 427/353 |
| 4,451,262 | A | * | 5/1984 | Mayer et al. | 8/125 |
| 4,673,509 | A | * | 6/1987 | Davis et al. | 210/699 |
| 4,765,796 | A | * | 8/1988 | Harper, Jr. et al. | 8/115.7 |
| 4,874,526 | A | | 10/1989 | Grade et al. | 210/697 |
| 4,972,632 | A | | 11/1990 | Brueck | 51/105 |
| 5,695,528 | A | * | 12/1997 | Komori et al. | 8/127.1 |
| 6,124,248 | A | * | 9/2000 | O'Bryant et al. | 508/216 |
| 6,156,715 | A | | 12/2000 | Lentsch et al. | 510/224 |
| 6,177,392 | B1 | | 1/2001 | Lentsch et al. | 510/224 |
| 6,214,777 | B1 | * | 4/2001 | Li et al. | 508/388 |

FOREIGN PATENT DOCUMENTS

| | | | |
|---|---|---|---|
| CA | 2082994 | 5/1993 | C07F/9/54 |
| WO | 98/30675 | 7/1998 | C11D/17/00 |

* cited by examiner

*Primary Examiner*—John Hardee
(74) *Attorney, Agent, or Firm*—Schwegman, Lundberg, Woessner & Kluth, P.A.

(57) ABSTRACT

The present invention provides a composition that is suitable for lowering the alkalinity of a textile. The composition is also suitable for cleansing or treating a hard surface or a porous surface. The composition exhibits stability as a solution or as a dispersion at a temperature of about 0° C. to about 8° C. The composition includes a carrier, an acid, and a quaternary phosphonium compound, or a suitable salt or solvate thereof. The present invention also provides a method for cleansing or treating a surface. The method includes contacting the surface with an effective amount of a composition of the present invention to provide a treated or cleansed surface having a pH below about 7.5. The present invention also provides a method for preparing a composition of the present invention. The method includes combining the carrier, the acid, and the quaternary phosphonium compound, or a suitable salt or solvate thereof, in any order, to provide the composition.

27 Claims, No Drawings

STABILIZED OXALIC ACID SOUR

BACKGROUND OF THE INVENTION

Many compositions currently used in the industrial and institutional industry do not exhibit stability over broad temperature ranges typically encountered with the shipping and storage of these compositions. Such compositions include, e.g. compositions useful in the lowering of the alkalinity of textiles. These compositions are typically transported and stored in unheated transportation vehicles (e.g., trucks) and stored in unheated units (e.g., sheds or warehouses). The lack of stability of these compositions can often be seen as a solidification (i.e., precipitation) of one or more components in the composition. This solidification can result, e.g., in a loss of homogeneity in pumping the composition, which can cause nozzle plugging. This is time consuming as well as financially expensive.

Currently, there is a need for a composition that is suitable for lowering the alkalinity of a textile while exhibiting stability as a solution or as a dispersion at a temperature of about 0° C. to about 8° C.

SUMMARY OF THE INVENTION

It has surprisingly been discovered that a composition suitable for lowering the alkalinity of a textile or suitable for cleansing or treating a hard surface or a porous surface while exhibiting stability as a solution or as a dispersion at a temperature of about 0° C. to about 8° C. can be obtained by the incorporation of a phosphonium compound into the composition.

The composition of the present invention, upon cooling to about 0° C. (e.g. from about 0° C. to about 8° C.), may form a colloidal suspension or may form a dispersion with less freezing or with less crystal formation than known compositions suitable for lowering the alkalinity of a textile or suitable for cleansing or treating a hard surface or a porous surface. The composition of the present invention will also require less agitation or will require less heating than known compositions suitable for lowering the alkalinity of a textile or suitable for cleansing or treating a hard surface or a porous surface, to redissolve any suspended particles in solution.

The present invention provides a composition that is suitable for lowering the alkalinity of a textile. The composition is also suitable for cleansing or treating a hard surface or a porous surface. The composition exhibits stability as a solution or as a dispersion at a temperature of about 0° C. to about 8° C. The composition includes a carrier, an acid, and a quaternary phosphonium compound, or suitable salt or solvate thereof In one preferred embodiment, the carrier (e.g., water) is present in about 40 wt. % to about 99 wt. % of the composition; the acid (e.g., oxtail acid) is present in about 1 wt. % to about 60 wt. % of the composition; the quaternary phosphonium compound (e.g., tetrakis (hydroxymethyl) phosphonium sulfate) is present in about 0.001 wt. % to about 10 wt. % of the composition.

The present invention also provides a method for cleansing or treating a surface. The method includes contacting the surface with an effective amount of a composition of the present invention to provide a treated or cleansed surface having a pH below about 7.5. In one embodiment, the surface is a hard surface (e.g., cooking utensil, eating utensil, a hard architectural surface, a motorized vehicle, or a food material).

The present invention also provides a method for preparing a composition of the present invention. The method includes combining the carrier, the acid, and the quaternary phosphonium compound, or a suitable salt or solvate thereof, in any order, to provide the composition. In one embodiment, the quaternary phosphonium compound contacts the carrier before the acid contacts the carrier. In another embodiment, the method further includes heating stirring, shaking, or agitating the composition.

DETAILED DESCRIPTION OF THE INVENTION

The following definitions are used, unless otherwise described: halo is fluoro, chloro, bromo, or iodo. Alkyl, alkoxy, alkenyl, alkynyl, etc. denote both straight and branched groups; but reference to an individual radical such as "propyl" embraces only the straight chain radical, a branched chain isomer such as "isopropyl" being specifically referred to. Aryl denotes a phenyl radical or an ortho-fused bicyclic carbocyclic radical having about nine to ten ring atoms in which at least one ring is aromatic. Heteroaryl encompasses a radical attached via a ring carbon of a monocyclic aromatic ring containing five or six ring atoms consisting of carbon and one to four heteroatoms each selected from the group consisting of non-peroxide oxygen, sulfur, and N(Q) wherein Q is absent or is H, O, $(C_1–C_4)$ alkyl, phenyl or benzyl, as well as a radical of an ortho-fused bicyclic heterocycle of about eight to ten ring atoms derived therefrom, particularly a benz-derivative or one derived by fusing a propylene, trimethylene, or tetramethylene diradical thereto.

Specific and preferred values listed below for radicals, substituents, and ranges, are for illustration only; they do not exclude other defined values or other values within defined ranges for the radicals and substituents Specifically, $(C_1–C_{24})$alkyl can be methyl, ethyl, propyl, isopropyl, butyl, iso-butyl, sec-butyl, pentyl, 3-pentyl, hexyl, heptyl, octyl, nonyl, decyl, undeclyl, dodecyl, tridecyl, tetradecyl, or eicosyl; $(C_3–C_8)$cycloalkyl can be cyclopropyl, cyclobutyl, cyclopentyl, or cyclohexyl; $(C_1–C_{24})$alkoxy can be methoxy, ethoxy, propoxy, isopropoxy, butoxy, iso-butoxy, sec-butoxy, pentoxy, 3-pentoxy, hexyloxy, heptoxy, octoxy, nonoxy, dedecoxy, undecoxy, dodecoxy, tridecoxy, tetradecoxy, or eicosoxy; $(C_2–C_6)$alkenyl can be vinyl, allyl, 1-propenyl, 2-propenyl, 1-butenyl, 2-butenyl, 3-butenyl, 1,-pentenyl, 2-pentenyl, 3-pentenyl, 4-pentenyl, 1-hexenyl, 2-hexenyl, 3-hexenyl, 4-hexenyl, or 5-hexenyl; $(C_2–C_6)$alkynyl can be ethenyl, 1-propynyl, 2-propynyl, 1-butynyl, 2-butynyl, 3-butynyl, 1-pentynyl, 2-pentynyl, 3-pentynyl, 4-pentynyl, 1- hexynyl, 2-hexynyl, 3-hexynyl, 4-hexynyl, or 5-hexynyl; aryl can be phenyl, indenyl, or naphthyl; and heteroaryl can be furyl, imidazolyl, triazolyl, triazinyl, oxazoyl, isoxazoyl, thiazolyl, isothiazoyl, pyrazolyl, pyrrolyl, pyrazinyl, tetrazolyl, pyridyl, (or its N-oxide), thienyl, pyrimidinyl (or its N-oxide), indolyl, isoquinolyl (or its N-oxide) or quinolyl (or its N-oxide).

In cases where compounds are sufficiently basic or acidic to form stable nontoxic acid or base salts, use of the compounds as salts may be appropriate. Examples of acceptable salts are organic acid addition salts formed with acids which form an anion, for example, tosylate, methanesulfonate, acetate, citrate, malonate, tartarate, succinate, benzoate, ascorbate, ketoglutarate, and glycerophosphate. Suitable inorganic salts may also be formed, including hydrochloride, phosphate, sulfate, nitrate, bicarbonate, and carbonate salts.

Acceptable salts may be obtained using standard procedures well known in the art, for example by reacting a sufficiently basic compound such as an amine with a suitable acid affording an acceptable anion. Alkali metal (for example, sodium, potassium or lithium) or alkaline earth metal (for example calcium) salts of carboxylic acids can also be made.

Any suitable carrier can be employed in the composition, provided the composition exhibits stability as a solution or as a dispersion at a temperature of about 0° C. to about 8° C. Preferably, the carrier is water, wherein the water can optionally be deionized. Alternatively, the carrier can be a water-soluble solvent. Suitable water-soluble solvents include alcohols and polyols such as ethanol, propanol, ethylene glycol, propylene glycol, or any combination thereof. In addition, the water-soluble solvent can be used alone or in conjunction with water.

The carrier can be present in any suitable amount, provided the composition exhibits stability as a solution or as a dispersion at a temperature of about 0° C. to about 8° C. Preferably, the carrier can be present in about 40 wt. % to about 99 wt. % of the composition. More preferably, the carrier can be present in about 70 wt. % to about 80 wt. % of the composition.

In an alternative embodiment of the present invention, the carrier can be solid carrier. Suitable solid carriers include, e.g., caustic hydration, polymer melt (e.g., polyethylene glycol), urea occlusion, melt solidification, and an e-form TM See, e.g., co-pending U.S. Pat. Ser. No. 08/989,824 and U.S. Pat. Ser. No. 08/181,493, now U.S. Pat. Nos. 6,258,765 and 6,177,392, RESPECTIVELY.

The acid can be one or more organic acids, one or more inorganic acid, or a combination thereof, provided the acid can effectively lower the pH of the composition and the composition exhibits stability as a solution or as a dispersion at a temperature of about 0° C. to about 8° C. Preferably, the acid (e.g., one or more organic acids, one or more inorganic acids, or combination thereof) will be present in an amount such that the pH of the composition is between about 2 and about 3.

Suitable organic acids are disclosed, e.g., in *Aldrich Handbook of Fine Chemicals and Laboratory Equipment*, Aldrich, (2000–2001), Milwaukee, Wis. The organic acid can optionally coordinate ions (e.g., iron) in the composition. Preferred organic acids will include one or more carboxylic acid groups. As used herein, a carboxylic acid group is a carbonyl group that is bonded to a hydroxyl group (e.g., C(=O)OH). Suitable organic acids having one or more carboxylic acid group are disclosed, e.g., in *Aldrich Handbook of Fine Chemicals and Laboratory Equipment*, Aldrich, (2000–2001), Milwaukee, Wis. Preferred organic acids having one or more carboxylic acid groups include oxalic acid, citric acid, adipid acid, succinic acid, glutaric acid, glycolic acid, acetic acid, formic acid, or a combination thereof. More preferably, the organic acids having one or more carboxylic acid groups can be oxalic acid.

The organic acid (e.g., oxalic acid) can be present in any amount provided the organic acid can effectively lower the pH of the composition and the composition exhibits stability as a solution or as a dispersion at a temperature of about 0° C. to about 8° C. Preferably, the organic acid (e.g., oxalic acid) can be present in about 1 wt. % to about 60 wt. % of the composition. More preferably, the organic acid (e.g., oxalic acid) can be present in about 4 wt. % to about 8 wt. % of the composition.

Suitable inorganic acids are disclosed, e.g., in *Aldrich Handbook of Fine Chemicals and Laboratory Equipment*, Aldrich, (2000–2001), Milwaukee, Wis. Preferred inorganic acids include, e.g., phosphoric acid, hydrofluorosilisic acid, hydrochloric acid, sulfuric acid, sodium bisulfite, or a combination thereof. More preferably, the inorganic acids can be phosphoric acid. Phosphoric acid is commercially available from, e.g., Aldrich (Milwaukee, Wis). Phosphoric acid is typically available as an 75 wt. % solution in water. With the use of 75 wt. % phosphoric acid, it is necessary to account for the 25 wt. % of water present in the phosphoric acid in formulating the composition of the present invention.

The inorganic acid (e.g., phosphoric acid) can be present in any amount provided the inorganic acid can effectively lower the pH of the composition and he composition exhibits stability as a solution or as a dispersion at a temperature of about 0° C. to about 8° C. Preferably, the inorganic acid (e.g., phosphoric acid) can be present up to about 60 wt. % of the composition. More preferably, the inorganic acid (e.g., phosphoric acid) can be present in about 10 wt. % to about 20 wt. % of the composition.

Any suitable phosphonium compound can be employed, provided the composition exhibits stability as a solution or as a dispersion at a temperature of about 0° C. to about 8° C. Suitable phosphonium compounds are disclosed, e.g., in Canadian Patent No. 2,082,994, U.S. Pat. No. 4,874,526, U.S. Pat. No. 4,265,945, U.S. Pat. No. 4,673,509, and European Patent No. 322,578.

Preferably, the phosphonium compound can be a quaternary phosphonium compound. Any suitable quaternary phosphonium compound can be employed, provided the composition exhibits stability as a solution or as a dispersion at a temperature of about 0° C. to about 8° C.

Preferably, the phosphonium compound can be a compound of formula (I):

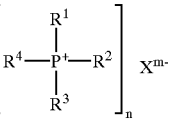

wherein $R^1$–$R^4$ are each independently ($C_1$–$C_{24}$)alkyl, ($C_2$–$C_6$)alkenyl, ($C_2$–$C_6$)alkynyl, ($C_3$–$C_8$)cycloalkyl, ($C_1$–$C_{24}$)alkyl($C_3$–$C_8$)cycloalkyl, aryl, heteroaryl, ($C_1$–$C_{24}$ alkyl aryl, or ($C_1$–$C_{24}$)alkyl heteroaryl; wherein any alkyl, cycloalkyl, heteroaryl, or a of $R^1$–$R^4$ can optionally be substituted with one or more hydroxy, halo, or ($C_1$–$C_{24}$)alkoxy and any aryl, heteroaryl, or cycloalkyl of $R^1$–$R^4$ can optionally be substituted with ($C_1$–$C_{24}$)alkyl;

X is F, Cl, Br, I or $SO_4$, $NO_3$, rhodanide, $ClO_4$, $ICl_2$, N,N-dialkyldithiocarbamate, $CO_3$, —$S_2CHNH(CH_2)_2NHCS_2$, $[Fe(CN)_5(NO)]$, $PO_4$, $[Cu(CN)_4]$, or $[M(L)_6]$, wherein M is Fe, Co, or Mn and L is CN or rhodanide;

n is 1 to about 4; and m is 1 to about 4.

A specific value for $R^1$ is $CH_2OH$.

A specific value for $R^2$ is $CH_2OH$.

A specific value for $R^3$ is $CH_2OH$.

A specific value for $R^4$ is $CH_2OH$.

A specific value for X is $SO_4$.

A specific value for n is 2.

A specific value for m is 2.

Suitable specific quaternary phosphonium compounds include tetrakis (hydroxymethyl) phosphonium sulfate, tetrabutyl phosphonium bromide, tetrabutyl phosphonium chloride, tributyl (tetradecyl) phosphonium chloride, trioctyl (octadecyl) phosphonium iodode, tetrakis (hydroxymethyl) phosphonium chloride, (ethoxycarbonylmethyl) triphenylphosphonium bromide, (ethoxycarbonylmethyl) triphenylphosphonium chloride, (2-hydroxyethyl) triphenylphosphonium bromide, (2-hydroxyethyl) triphenylphosphonium chloride, (methoxycarbonylmethyl) triphenylphosphonium bromide, and (methoxycarbonylmethyl)triphenylphosphonium chloride. Preferably, the quaternary phosphonium compound is tetrakis (hydroxymethyl) phosphonium sulfate, which is commercially available as Tolcide PS200 or Tolcide PS75 from Albright & Wilson (Glen Allen, Va.).

Any suitable amount of phosphonium compound can be present in the composition, provided the composition exhibits stability as a solution or as a dispersion at a temperature of about 0° C. to about 8° C. Preferably, the phosphonium compound (e.g., tetrakis (hydroxymethyl) phosphonium sulfate) is present in about 0.0(1 wt. % to about 10 wt. % of the composition. More preferably, the phosphonium compound (e.g., tetrakis (hydroxymethyl) phosphonium sulfate) is present in about 2 wt. % to about 6 wt. % of the composition.

The composition can optionally include a neutralizing agent. Any suitable neutralizing agent can be employed in the composition, provided the composition exhibits stability as a solution or as a dispersion at a temperature of about 0° C. to about 8° C. Preferably, the neutralizing agent is an alkaline metal hydroxide, an alkyl amine, an organic acid, an inorganic acid, or any combination thereof. The neutralizing agent can be present in any suitable amount, provided the composition exhibits stability as a solution or as a dispersion at a temperature of about 0° C. to about 8° C. Preferably, the neutralizing agent is present in an amount such that the pH of the composition is between about 4.5 and about 9.5.

The composition can optionally include a chelating agent. Where water is used as carrier, there is a tendency for the hardness cations (e.g., calcium, magnesium, and/or ferrous ions) to reduce the efficacy of the composition of the present invention. The hardness cations can even form precipitates when coming into contact with ions such as sulfates and carbonates. Water conditioning agents (e.g., chelating agents) can be used to form complexes with the hardness ions.

Any suitable chelating agent can be employed in the composition, provided the composition exhibits stability as a solution or as a dispersion at a temperature of about 0° C. to about 8° C. Suitable chelating agents include ethylene diamine tetraacetic acid, or a suitable salt thereof; diethylene triamine pentacetic acid, or a suitable salt thereof; nitrilotriacetic acid, or a suitable salt thereof; and N-hydroxyethylene diamine triacetic acid, or a suitable salt thereof. Preferably, the chelating agent is ethylene diamine tetraacetic acid (EDTA), or a suitable salt thereof. EDTA is commercially available from Dow Chemicals (Midland, Mich.).

The chelating agent can be present in any suitable amount, provided the composition exhibits stability as a solution or as a dispersion at a temperature of about 0° C. to about 8° C. Preferably, the chelating agent is present in about 1 wt. % to about 10 wt. % of the composition.

The composition can optionally include one or more soil release agents. Suitable soil release agents include, e.g., cellulosic polymers, polyacrylate polymers, and low molecular polyester polymers. The soil release agent can be present in any suitable amount, provided the composition exhibits stability as a solution or as a dispersion at a temperature of about 0° C. to about 8° C. Preferably, the 3oil release agent can be present in about 1% wt. % to about 10% wt. % of the composition.

The composition can optionally include one or more suitable anti-wrinkle agents. Suitable anti-wrinkle agents include, e.g., curable amine functional sillcone agents. The anti-wrinkle agent can be present in any suitable amount, provided the composition exhibits stability as a solution or as a dispersion at a temperature of about 0° C. to about 8° C. Preferably, the anti-wrinkle agent can be present in about 0.5 wt. % to about 20 wt. % of the composition.

The composition can optionally include one or more softeners. Suitable softeners include, e.g., dialkyldimethylammonium salts, imidazolinium salts diamido quaternary ammonium salts, or other specialty cationic compounds. Specifically, suitable softeners include, e.g., quaternary ammonium compounds (e.g. distearyl dimethyl ammonium chloride; bis(2-hydroxy-3-tallow-alkoxypropyl)dimethyl ammonium chloride; bis(tallow-alkycarboxymethyl) dimethyl ammonium chloride; bis(tallow-alkylcarboxy) propyltrimethyl ammonium chloride; bis(tallow-amidoethyl)dimethyl ammonium chloride; and tallow-alkyl-(tallow-alkylcarboxyethyl) acetamidoethyl ammonium chloride); imidazolinium compounds (e.g., 1-(fatty acid amidoethyl)-2-(fatty alkyl)-3-methyl-imidazolinium methyl sulfate; and 1,3-bis(tallow-amidoethyl)-2-methyl-imidazolimum acetate); di-quaternary compounds (e.g., N-Tallow alkyl-N,N'N'-tris (2-hydroxyethyl)- 1,3-propanediammonium dichloride; substituted propylenediammonium chloride; and 1,1-ethylene-bis(2-tallow-alkyl-3methyl-imidazolinium)-methyl sulfate); and miscellaneous softeners (e.g., alkylpyridinium salt; alkyltetrahydropyrimidinium salts; amine functional silicones; dimethyl silicones; silicone polyethers; diester or diamide quaternary ammonium compounds; TEA ester quaternary ammonium compounds, or a suitable salt thereof). The softener can be present in any suitable amount, provided the composition exhibits stability as a solution or as a dispersion at a temperature of about 0° C. to about 8° C. Preferably, the softener can be present in about 0.5 wt. % to about 15 wt. % of the composition.

The composition can optionally include one or more suitable antimicrobial agents. Suitable antimicrobial agents include, e.g., tetrakishydroxymethyl phosphonium sulfate (THPS) which has efficacy against a wide range of microorganisms (e.g., bacteria, algae, slime, and fungi). THPS is a rapid acting biocide that is effective in the control of legionella and sulfate reducing bactria. THPS is also effective over a wide range of pH and temperature. THPS is compatible with many other water treatment additives.

Other suitable antimicrobial agents include, e.g., disinfectants, antiseptics and preservatives (e.g., phenols, including halo- and nitrophenols and substituted bisphenols such as 4-hexylresorcinol, 2-benzyl-4-chlorophenol and 2,4,4'-Arichlor-2'hydroxydiphenyl ether, organic and inorganic acids and its esters and salts such as dehydroacetic acid, peroxycarboxylic acid, peroxyacetic acid, methyl p-hydroxy benzoic acid, aldehydes such as gluteraldehyde, antimicrobial dyes such as acridines, triphenylmethane dyes and quinones and halogens including iodine and chlorine compounds, cationic agents such as quaternary ammonium compounds). Quaternary ammonium salts which can be used as the antimicrobial compound in the souring product include specifically, but not exclusively, ($C_8$–$C_{24}$) alkyltrimethyl quaternary ammonium salts such as hexadecyltrimethyl quaternary ammonium chloride and octadecyltrimethyl quaternary ammonium chloride; ( $C_8$–$C_{24}$) ialkyl dimethyl quaternary ammonium compounds such as didecyl-dimethyl quaternary ammonium chloride; alkyl -arylquaternary ammonium salts such as ($C_8$–$C_{24}$ alkyl-kimethyl-benzyl quaternary ammonium chloride, ($C_8$–$C_{24}$) alkyl-dimethylbenzalkonium chloride, and dimethyldichlorobenzyl quaternary ammonium chloride, and various others such as hexadecyl-pyridinium chloride, benzethonium chloride and methylbenzethonium chloride. The antimicrobial agent can be present in any suitable amount, provided the composition exhibits stability as a solution or as a dispersion at a temperature of about 0 ° C. to about 8 ° C. Preferably, the antimicrobial agent can be present in about 0.1 wt. % to about 20 wt. % of the composition.

The composition can optionally include a tint or a dye. Suitable tints include, e.g., a combination of direct blue 199 and acid red 52 or a combination of reactive blue 199 and reactive red 120, acid violet 7, or Liquitint Red X-1236, which are commercially available from Clariant Corporation (Charlotte, N.C.) and Chromatech Inc. (Canton, Mich.). The tint or dye can be present in any suitable amount, provided the composition exhibits stability as a solution or as a dispersion at a temperature of about 0° C. to about 8° C. Preferably, the tint can be present in about 0.0001 wt. % to about 1 wt. % of the composition.

Known compositions in the industrial and institutional industry that are suitable for lowering the alkalinity of a textile or are suitable for cleansing or treating a hard surface or a porous surface typically include water, one or more acids (e.g., organic acid and inorganic acid). These compositions, however, have a tendency to freeze or crystallize as the temperature of the composition approaches 0° C. (e.g., from about 8° C. to about 0° C.). In addition, the compositions, upon freezing or crystallizing, require a considerable amount of heating or agitation to redissolve the crystals or melt the frozen particles.

The composition of the present invention is stable as a solution or as a dispersion at a temperature down to about 0° C. More specifically, the composition of the present invention is stable as a solution or as a dispersion at a temperature of about 0°C. to about 8° C.

As used herein "stability" refers to the tendency of a composition to remain as a solution or as a dispersion as the temperature of the composition approaches 0° C. (e.g., from about 0° C. to about 8° C.). As the temperature of a composition approaches 0° C. (e.g., from about 0° C. to about 8° C.), the composition will not undergo, to any appreciable degree, freezing or crystallization. The composition may form a colloidal suspension or may form a dispersion, viewed as a cloudy white solution, but upon slight agitation or slight heating, the suspended particles will redissolve in solution.

As a result, the compositions of the present invention offer advantages over known compositions that include water and one or more acids (organic acids and inorganic acids). Specifically, the compositions of the present invention, upon cooling to about 0° C. (e.g., from about 0° C. to about 8° C.), may form a colloidal suspension or may form a dispersion. However, the compositions of the present invention, upon cooling to about 0° C. (e.g., from about 0° C. to about 8° C.), will not freeze or produce crystals as readily as known compositions that are suitable for lowering the alkalinity of a textile or are suitable for cleansing or treating a hard surface or a porous surface. As such, the compositions of the present invention will require less agitation or will require less heating, than known compositions that are suitable for lowering the alkalinity of a textile or are suitable for cleansing or treating a hard surface or a porous surface, to redissolve the suspended particles in solution.

As used herein, a "dispersion" refers to a system of minute particles (solid, liquid, or gaseous) distinct and separate from one another and suspended in a liquid, gaseous, or liquid medium. A dispersion can also generally refer to colloidal particles suspended in a medium.

The composition of the present invention is useful in the industrial and institutional industry for lowering the alkalinity of a surface or for cleansing or treating a surface. The surface is contacted with an effective amount of a composition of the present invention to provide a treated or cleansed surface having a pH below about 7.5.

In one embodiment, the surface is a hard surface (e.g., a cooking utensil, eating utensil, a hard architectural surface, a motorized vehicle, or a food material). Specifically, the hard architectural surface can be a wall, floor, window counter top, or combination thereof. Specifically, the motorized vehicle can be a car, motorcycle, truck, train, plane, jet, boat, or ship. Specifically, the food material can be a fruit, vegetable, meat, or poultry. In an alternative embodiment, the surface can be a porous surface (e.g., textile or porous architectural surface). Specifically, the porous architectural surface can be a carpet or wallpaper.

Prior to the composition of the present invention contacting the surface, the surface can optionally be contacted with a detergent. Any suitable detergent can be employed, provided the surface is effectively cleaned. Suitable detergents include, e.g., TRI-STAR L-2000 XP, TRI-STAR SOLAR BRITE, TRI-STAR SPECTRA, TRI-STAR SOLAR BRITE NP, LIQUID SPECIAL HC, SOLID SURGE PLUS, SOLID SURGE PLUS NP, SOLID ULTRA SURGE, SOLID ULTRA SURGE NP, and ROYAL BRITE, which are commercially available from Ecolab (St. Paul, Minn.).

The surface can be contacted with the detergent for a suitable length of time such that the detergent can effectively clean the surface. Preferably, the surface can contacted with the detergent for a period of time of about 0.1 minutes to about 60 minutes. In addition, the surface can be contacted with the detergent at a temperature above ambient temperature. For example, the surface can be contacted with the detergent at a temperature of about 1° C. to about 72° C.

The surface can optionally be rinsed with a carrier (e.g., water). Specifically, the surface can be rinsed with water before the surface is contacted with the detergent. Alternatively, the surface can be rinsed with water after the surface is contacted with the detergent but before the surface is contacted with the composition. Alternatively, the surface can be rinsed with water after the surface is contacted with the composition.

The composition of the present invention can be formulated in any suitable manner, provided each of the components maintains its stability during and after the formulation process and provided the composition exhibits stability as a solution or as a dispersion at a temperature of about 0° C. to about 8° C. In the event some of the components of the composition are incompatible in a concentrated form, the composition can be formulated at use-level concentrations by combining two or more formulated component concentrates. Preferably, each of the acid and phosphonium compound, in any order, are contacted with the carrier. More preferably, each of the above components are added to the carrier, in any order. The resulting mixture can then be heated, stirred, shaken, or agitated to facilitate each of the components effectively dissolving in the carrier.

The composition of the present invention can optionally be diluted with one or more carriers (e.g., water or a water soluble solvent), prior to use. The specific carrier and the amount thereof will typically depend upon the specific components of the composition, the amount thereof, as well as the utility of the composition. For example, when the composition is employed to lowering the alkalinity of a textile, the composition will typically include water in about 70 wt. % to a out 80 wt. % of the composition; phosphoric acid in about 10 wt. % to about 20 wt. % of the composition; oxalic acid in about 4 wt. % to about 8 wt. % of the composition; and Tolcide PS200 in about 2 wt. % to about 6 wt. % of the composition.

The present invention will now be illustrated by the following non-limiting Examples.

EXAMPLES

Example 1

1. Solution #1:

| | active wt. % | wt. % |
|---|---|---|
| Water (zeolite softened) | 75.00 | 69.99 |
| direct blue 199 and acid red 52 | 0.01 | 0.01 |
| Phosphoric acid, 75% in water | 15.00 | 20.00 |
| Oxalic acid (crystalline) dihydrate | 6.00 | 6.00 |
| Tolcide PS75 | 4.00 | 4.00 |
| Total | | 100.00% |

The analysis examined the cold temperature stability of solution #1 with varied amounts of Tolcide PS 75, which were added on top of the #1 solution. Additions of 2%, 4%, and 6% were tested at 40° F. (4° C.) for cold temperature stability. The results can be found in the table below.

TABLE 1

Cold temperature stability results for solution #1 with added amounts of Tolcide PS 75

| Solution | Cold Temperature Formation of Precipitate | Cold Temperature Precipitate Description |
|---|---|---|
| Solution #1 | Precipitate formed after nine days | White Crystals in ⅓ of Solution |
| Solution #1 w/ Additional 2% Tolcide PS 75 | Precipitate formed after six days | White powder-like ppt on bottom |
| Solution #1 w/ Additional 4% Tolcide PS 75 | No Precipitate formed in the testing period of two weeks | N/A |
| Solution #1 w/ Additional 6% Tolcide PS 75 | Precipitate formed after six days | White powder-like ppt on bottom, trace amounts |

The results indicate that the addition of Tolcide PS 75 significantly reduced or inhibited the solid precipitation in solution #1 at low temperature (e.g., about 4° C.).

All publications, patents, and patent documents are incorporated by reference herein, as though individually incorporated by reference. The invention has been described with reference to various specific and preferred embodiments and techniques. However, it should be understood that many variations and modifications may be made while remaining within the spirit and scope of the invention.

What is claimed is:

1. A composition composition comprising a carrier, an acid, and 2 to 10 wt. % of a quaternary phosphonium compound, or a suitable salt or solvate thereof; wherein the composition exhibits stability as a solution or as a dispersion at a temperature of about 0° C. to about 8° C.;

the acid is an organic acid, an inorganic acid, or a combination thereof; and the organic acid is oxalic acid.

2. The composition of claim 1 wherein the carrier is water.

3. The composition of claim 2 wherein the water is softened or neutralized.

4. The composition of claim 1 wherein the carrier is a caustic hydration, a polymer melt (polyethylene glycol), an urea occlusion, a melt solidification, or an e-form TM.

5. The composition of claim 1 wherein the carrier is present in about 40 wt. % to about 99 wt. % of the composition.

6. The composition of claim 1 wherein the composition comprises oxalic acid.

7. The composition of claim 1 wherein the organic acid is present in about 1 wt. % to about 60 wt. % of the composition.

8. The composition of claim 1 wherein the inorganic acid is phosphoric acid, hydrofluoric acid, hydrochloric acid, sulfuric acid, sodium bisulfite, or a combination thereof.

9. The composition of claim 8 wherein the inorganic acid is phosphoric acid.

10. The composition of claim 9 wherein the phosphoric acid is present up to about 60 wt. % of the composition.

11. The composition of claim 1 wherein the quaternary phosphonium compound is a compound of formula (I):

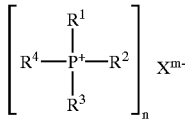

(I)

wherein $R^1$–$R^4$ are each independently ($C_1$–$C_{24}$)alkyl, ($C_2$–$C_6$)alkenyl, ($C_2$–$C_6$)alkynyl, ($C_3$–$C_8$)cycloalkyl, ($C_1$–$C_{24}$)alkyl($C_3$–$C_8$)cycloalkyl, aryl, heteroaryl, ($C_1$–$C_{24}$)alkyl aryl, or ($C_1$–$C_{24}$)alkyl heteroaryl; wherein any alkyl, cycloalkyl, heteroaryl, or aryl of $R^1$–$R^4$ can optionally be substituted with one or more hydroxy, halo, or ($C_1$–$C_{24}$)alkoxy and any aryl, heteroaryl, or cycloalkyl of $R^1$–$R^4$ can optionally be substituted with ($C_1$–$C_{24}$)alkyl;

X is F, Cl, Br, I or $SO_4$, $NO_3$, rhodanide, $ClO_4$, $ICl_2$, N,N-diakyldithiocarbamate, $CO_3$, —$S_2CHNH(CH_2)_2NHCS_2$, $[Fe(CN)_5(NO)]$, $PO_4$, $[Cu\text{-}CN)_4]$, or $[M(L)_6]$, wherein M is Fe, Co, or Mn and L is CN or rhodanide;

n is 1 to about 4; and m is 1 to about 4.

12. The composition of claim 11 wherein $R^1$–$R^4$ is $CH_2OH$, X is $SO_4$, n is 2, ad m is 2.

13. The composition of claim 1 wherein the quaternary phosphonium compound is tetrakis(hydroxymethyl) phosphonium sulfate.

14. The composition of claim 1 further comprising a tint, a dye, a soil release agent, an anti-wrinkle agent, a softener, an antimicrobial agent, or a combination thereof.

15. The composition of claim 14 wherein the tint is a combination of direct blue 199 and acid red 52 or a combination of reactive blue 199 and reactive red 120.

16. The composition of claim 14 wherein the soil release agent is a cellulasic polymer, a polyacrylate polymer, a low molecular polyester polymer, or any combination thereof.

17. The composition of claim 14 wherein the anti-wrinkle agent is a curable amine functional silicone agent.

18. The composition of claim 14 wherein the softener is a dialkyldimethylammonium salt, an imidazolinium salt, a diamido quaternary ammonium salt, a quaternary ammonium compound, an imidazolinium compound, a di-quaternary compound; a substituted propylenediammonium chloride, a miscellaneous softener, or a suitable salt thereof.

19. The composition of claim 14 wherein the antimicrobial agent is tetrakishydroxymethyl phosphonium sulfate (THPS), a disinfectant, an antiseptic, a preservative, an antimicrobial dye, or any combination thereof.

20. The composition of claim 1 wherein the pH of the composition is between about 2 and about 3.

21. The composition of claim 1 that is suitable for lowering the alkalinity of a textile.

22. A method for preparing a composition comprising a carrier, an acid, and 2 to 10 wt. % of a quaternary phosphonium compound, or a suitable salt or solvate thereof; wherein the composition exhibits stability as a solution or as a dispersion at a temperature of about 0° C. to about 8° C.;

the acid is an organic acid, an inorganic acid, or a combination thereof; and the organic acid is oxalic acid, formic acid, or a combination thereof;

the method comprising combining the carrier, acid, and quaternary phosphonium compound, a suitable salt or solvate thereof, in any order, to provide the composition.

23. The method of claim 22 wherein the quaternary phosphonium compound contacts the carrier before the acid contacts the carrier.

24. The method of claim 22 further comprising heating stirring, shaking, or agitating the composition.

25. The method of claim 22 wherein the quaternary phosphonium compound is a compound of formula (I):

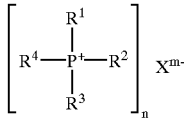

wherein $R^1$–$R^4$ are each independently ($C_1$–$C_{24}$)alkyl, ($C_2$–$C_6$)alkenyl, ($C_2$–$C_6$)alkynyl, ($C_3$–$C_8$)cycloalkyl, ($C_1$–$C_{24}$)alkyl($C_3$–$C_8$)cycloalkyl, aryl, heteroaryl, ($C_1$–$C_{24}$)alkyl aryl, or ($C_1$–$C_{24}$)alkyl heteroaryl; wherein any alkyl, cycloalkyl, heteroaryl, or aryl of $R^1$–$R^4$ can optionally be substituted with one or more hydroxy, halo, or ($C_1$–$C_{24}$)alkoxy and any aryl, heteroaryl, or cycloalkyl of $R^1$–$R^4$ can optionally be substituted with ($C_1$–$C_{24}$)alkyl;

X is F, Cl, Br, I or $SO_4$, $NO_3$, rhodanide, $ClO_4$, $ICl_2$, N,N-dialkyldithiocarbamate, $CO_3$, —$S_2CHNH(CH_2)_2NHCS_2$, $[Fe(CN)_5(NO)]$, $PO_4$, $[Cu(CN)_4]$, or $[M(L)_6]$, wherein M is Fe, Co, or Mn and L is CN or rhodanide;

n is 1 to about 4; and m is 1 to about 4.

26. The method of claim 25 wherein $R^1$–$R^4$ is $CH_2OH$, X is $SO_4$, n is 2, and m is 2.

27. The method of claim 22 wherein the quaternary phosphonium compound is tetrakis(hydroxymethyl) phosphonium sulfate.

* * * * *

UNITED STATES PATENT AND TRADEMARK OFFICE

CERTIFICATE OF CORRECTION

PATENT NO. : 6,503,875 B1 
DATED : January 7, 2003
INVENTOR(S) : Minyu Li and Lynne A. Olson It is certified that error appears in the above-identified patent and that said Letters Patent is hereby corrected as shown below:

Column 1,
Lines 9 and 33, insert -- , -- after "e.g.".
Line 51, insert -- . -- after "thereof".
Line 53, delete "oxtail" and insert -- oxalic -- therefor.

Column 2,
Line 33, insert -- . -- after "substituents".
Line 44, delete "1,-pentenyl" and insert -- 1-pentenyl -- therefor.

Column 3,
Line 27, insert -- . -- after "TM".
Line 28, delete "08/181,493" and insert -- 08/781,493 -- therefor.
Line 30, delete "RESPECTIVELY" and insert -- respectively -- therefor.
Line 48, delete "group" and insert -- groups -- therefor.

Column 4,
Line 6, delete "an" before "75 wt.%" and insert -- a -- therefor.
Line 44, delete "($C_1$-$C_{24}$" and insert -- ($C_1$-$C_{24}$) -- therefor.
Line 46, delete "a" before "of $R^1$-$R^4$" and insert -- aryl -- therefor.

Column 5,
Line 20, delete "0.0(1" and insert -- 0.001 -- therefor.

Column 6,
Line 2, delete "3oil" and insert -- soil -- therefor.
Line 55, delete "Arichlor" and insert -- trichlor -- therefor.
Line 67, delete "ialkyl" and insert -- dialkyl -- therefor.

Column 7,
Line 3, delete "($C_8$-$C_{24}$" and insert -- ($C_8$-$C_{24}$) -- therefor.

Column 8,
Line 35, insert -- be -- after "can".

Column 9,
Line 5, delete "a out" and insert -- about -- therefor.
Line 26, insert -- 2. Effect of Tolcide PS 75 on cold temperature stability of Solution #1 -- above the paragraph beginning with "The analysis examined".
Line 62, delete second instance of "composition".

UNITED STATES PATENT AND TRADEMARK OFFICE

CERTIFICATE OF CORRECTION

PATENT NO. : 6,503,875 B1 
DATED : January 7, 2003
INVENTOR(S) : Minyu Li and Lynne A. Olson It is certified that error appears in the above-identified patent and that said Letters Patent is hereby corrected as shown below:

Column 10,
Line 46, delete "$[Cu\text{-}CN)_4]$" and insert -- $[Cu(CN)_4]$ -- therefor.
Line 51, delete "ad" and insert -- and -- therefor.
Line 62, delete "cellulasic" and insert -- cellulosic -- therefor.

Column 12,
Line 5, insert -- (I) -- on the right side of the figure after "$X^{m-}$".
Line 21, delete "$ClO_4$" and insert -- $ClO_4$ --therefor.

Signed and Sealed this

Second Day of December, 2003

JAMES E. ROGAN
*Director of the United States Patent and Trademark Office*